US007094331B2

(12) United States Patent
Kiser

(10) Patent No.: US 7,094,331 B2
(45) Date of Patent: Aug. 22, 2006

(54) VISCOSITY MODIFICATION OF HEAVY HYDROCARBONS USING DIHYDRIC ALCOHOLS

(75) Inventor: Melvin D. Kiser, Huntington, WV (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 328 days.

(21) Appl. No.: 10/703,183

(22) Filed: Nov. 5, 2003

(65) Prior Publication Data

US 2005/0092652 A1 May 5, 2005

(51) Int. Cl.
*C10C 3/00* (2006.01)
*C10C 1/00* (2006.01)

(52) U.S. Cl. ..... 208/39; 208/22; 208/23; 208/44; 585/3; 137/13

(58) Field of Classification Search ..... 585/3; 208/39, 44, 22, 23; 137/13
See application file for complete search history.

(56) References Cited

U.S. PATENT DOCUMENTS 2,686,728 A 8/1954 Wallace
3,140,248 A 7/1964 Bell et al.
3,321,394 A * 5/1967 Mills ..... 208/45
4,008,194 A * 2/1977 Shintani ..... 523/140
4,066,159 A 1/1978 Romovacek
4,085,078 A 4/1978 McDonald
4,100,314 A * 7/1978 Wallouch ..... 427/228
4,151,003 A 4/1979 Smith et al.
4,220,474 A * 9/1980 Uemura et al. ..... 501/89
4,243,513 A 1/1981 Horowitz et al.
4,537,635 A 8/1985 Bart et al.
4,539,012 A 9/1985 Ohzeki et al.
4,671,848 A 6/1987 Miller et al.
4,877,513 A 10/1989 Haire et al.
4,957,911 A 9/1990 Ljusberg-Wahren
5,096,566 A 3/1992 Dawson et al.
5,320,671 A 6/1994 Schilling
5,328,505 A 7/1994 Schilling
5,474,607 A 12/1995 Holleran
5,746,906 A 5/1998 McHenry et al.
5,834,539 A 11/1998 Krivohlavek

* cited by examiner

*Primary Examiner*—Glenn Caldarola
*Assistant Examiner*—Prem C. Singh
(74) *Attorney, Agent, or Firm*—Emch, Schaffer, Schaub & Porcello Co. L.P.A.

(57) ABSTRACT

A low viscosity, high softening point heavy hydrocarbon material having a viscosity reducing amount of at least one dihydric alcohol dissolved therein, and a method for producing such heavy hydrocarbon material, are disclosed.

26 Claims, 1 Drawing Sheet

VISCOSITY MODIFICATION OF HEAVY HYDROCARBONS USING DIHYDRIC ALCOHOLS

FIELD OF THE INVENTION

The present invention relates to the use of dihydric alcohols such as ethylene glycol as viscosity modifiers for heavy hydrocarbons such as asphalt and pitch.

BACKGROUND OF THE INVENTION

Petroleum pitch competes with coal tar pitch in many applications where the pitch is used as a carbon source and/or as a binder. The critical properties that are evaluated when deciding what type of pitch to use include: (a) flow properties, as measured by softening point and/or viscosity, and (b) carbon yield, as measured by ASTM D 2488, Coking Value by Modified Conradson Carbon.

Another pitch property that is also becoming of increasing interest is the polycyclic aromatic hydrocarbon (PAH) content. The U.S. Pat. No. 5,746,906 patent describes a coal tar pitch having a low polycyclic aromatic hydrocarbon content and a method of making such pitch where a high softening point coal tar pitch (softening point of 120–175° C.) was mixed with a low softening point petroleum pitch to make a binder pitch having a softening point of 107–114° C. and a PAH content slightly above 15,000 ppm.

In the manufacture of coal tar pitch, if more low boiling point materials are left in the pitch product, the resulting product has a lower softening point and a lower viscosity. In the case of petroleum pitch manufacturing, a high softening point petroleum bitch can be "cut back" with a hydrocarbon liquid material to produce a petroleum pitch having a lower softening point and a lower viscosity at a given temperature. It has long been understood in the industry, until the present invention, that this relationship between the softening point and viscosity was unchangeable (i.e., if one were lowered, the other would be lowered also).

Generally speaking, for a given softening point/viscosity, a petroleum pitch will have a lower carbon yield than a coal tar pitch. However, despite a potentially lower carbon yield, petroleum pitch offers certain advantages over coal tar pitch. One advantage that petroleum pitch has over coal tar pitch is the increased solids content of the petroleum pitch material. Therefore, it is desired in the industry to fine a way to improve the other critical property (i.e., the "flow" or viscosity) of petroleum pitch.

In the past, many types of materials have been used to modify the flow properties of such petroleum products as pitch and asphalt. Historically, these have been petroleum based, non-oxygenated hydrocarbons such as diesel fuel or various types of fuel oils, kerosene or various cutback oils. However, the use of these solvent "cutback" materials often causes problems with flash point and volatility if too much solvent is used.

Examples of viscosity modification of bituminous materials include the use of a fluoro or chlorofluoro derivative of lower alkanes, such as disclosed in Smith et al., U.S. Pat. No. 4,151,003.

Still other methods include reducing the viscosity of heavy hydrocarbon oils by preheating a stream of heavy carbon hydrocarbon oil in a stream of gas, mixing under pressure, and passing through a nozzle to form fine oil droplets such that a strong shearing action is created as the heavy oil and gas are forced through an orifice, as described in Dawson et al. U.S. Pat. No. 5,096,566.

Various other viscosity modified emulsions are also described. For example, the Schilling U.S. Pat. No. 5,320,671 describes mixing a bituminous emulsion aggregate slurry with a cationic emulsifier prepared as a reaction process of a polyamine with polycarboxylic acid hydrides and a kraft lignin. Other emulsions are described in the Schilling U.S. Pat. No. 5,328,505, Holleran, U.S. Pat. No. 5,474,607, and Krivohlavek, U.S. Pat. No. 5,834,359.

Still other dispersant/emulsions are described in Wallace, U.S. Pat. No. 2,686,728; Ljusberg-Wahren, U.S. Pat. No. 4,957,511; McDonald, U.S. Pat. No. 4,085,078; Haire et al., U.S. Pat. No. 4,877,513 (also generally described in the abstract Haire, B. UNITAR 5$^{th}$ International Conference (Caracas 8/4-9/91) Proceedings V2, 121–126 (1991)); and Ohzeki et al., U.S. Pat. No. 4,539,012.

Another viscosity modifier is dibasic ester (DBE) which is a solvent that is used for certain coal tar pitch and tars that are pourable at room temperature. However, the dibasic esters are expensive and are limited in their applicability to less viscous coal tars. Also, the dibasic esters do not adequately modify the viscosity of more viscous pitches such as petroleum pitches.

Therefore, there is a need to produce a viscosity modifier that is useful with pitches, and in particular, petroleum pitches, but does not have the above described drawbacks associated with the viscosity modifiers currently in use.

In particular, there is a need for a viscosity modifier that provides improved characteristics to the pitch and the pitch end product.

There is a further need for a viscosity modifier useful with heavy hydrocarbons that provide improved safety features such as low volatility and low toxicity.

In the past, ethylene glycol has been used as a lubricant for coal tar pitches. U.S. Pat. No. 2,686,728 taught mixing 98 parts pulverized coal tar pitch with 2 parts, by, weight, of diethylene glycol and 5 parts, by with, water. The water helped to distribute the glycol over the pitch particles. Until the present invention, however, no one had thought to use dihydric alcohols such as ethylene glycol as a viscosity reduction agent for pitches, and, in particular, petroleum pitch.

SUMMARY OF THE INVENTION

In one aspect, the present invention relates to a method of reducing the viscosity of heavy hydrocarbon materials. According to one aspect of the present invention, the heavy hydrocarbon material is heated to produce a molten material. A viscosity reducing amount of at least one dihydric alcohol such as ethylene glycol is dissolved in the molten material. In certain embodiments, the starting heavy hydrocarbon material has a softening point above about 100° C. Also, in preferred embodiments, from about 0.5 to about 5%, and in certain embodiments to about 2%, by weight, of the dihydric alcohol is dissolved in the heavy hydrocarbon material.

According to certain aspects of the present invention, the heavy hydrocarbon material can comprise a petroleum pitch, coal tar pitch, or other suitable pitch materials.

In another aspect, the present invention relates to a low viscosity, high softening point, heavy hydrocarbon material having a relatively high softening point and a relatively high viscosity having a suitable amount of at least one dihydric alcohol dissolved in the heavy hydrocarbon material.

According to certain aspects of the present invention, the dihydric alcohol is selected from the group of ethylene glycol, diethylene glycol, tri-ethylene glycol and mixtures thereof.

Yet another aspect of the present invention relates to a method of reducing carcinogenicity of a pitch product made from a starter pitch. The starter pitch comprises a distillable carcinogenic fraction and a higher boiling point, or non-distillable, pitch fraction having a reduced carcinogen level and an unacceptable high viscosity and/or softening point. The method includes distilling from the starter pitch at least a portion of the distillable carcinogen fraction to produce a reduce carcinogen pitch fraction that has an unacceptable high molten viscosity. The viscosity of the reduced carcinogen pitch fraction is then reduced by dissolving therein a viscosity reducing amount of at least one dihydric alcohol. The product is a low carcinogen pitch product having an acceptable molten viscosity.

DETAILED DESCRIPTION OF THE PREFERRED EMBODIMENT

Figure 1:
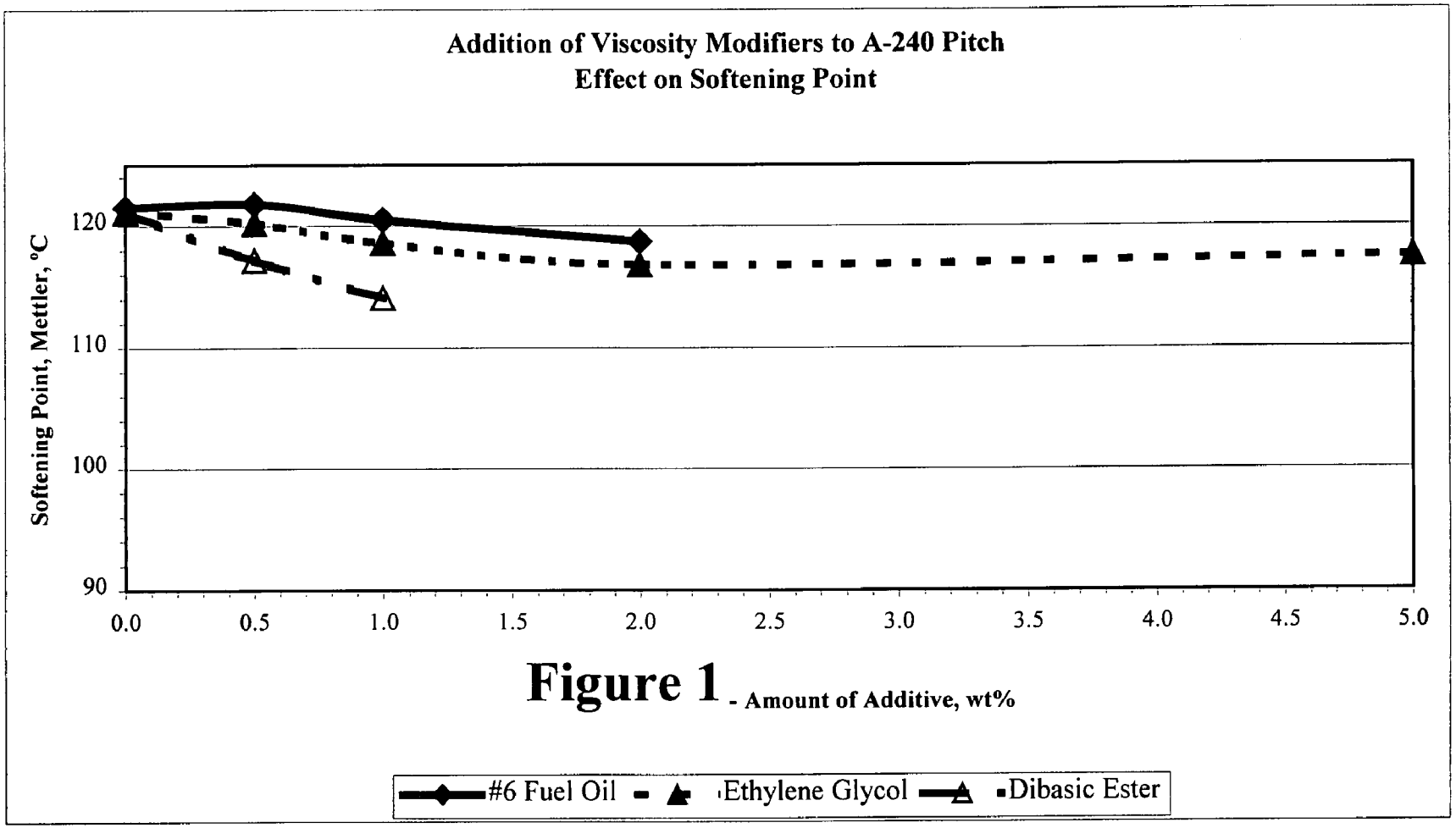
FIG. 1 is a graph showing effect on the softening point of A-240 pitch for various amounts of various viscosity modifiers for: #6 fuel, ethylene glycol, and dibasic ester (DBE).

The present invention relates to a method for reducing the viscosity of heavy hydrocarbon materials including, for example, pitch and asphalt type materials. The method involves heating the heavy hydrocarbon material to produce a molten material and dissolving in that molten material in a viscosity reducing amount of at least one dihydric alcohol. In certain preferred embodiments, the heavy hydrocarbon material has a softening point above about 100° C. and in other embodiments above about 120° C. In certain aspects, the present invention, relates to a method where from about 0.5 to about 5%, by wt, and in certain embodiments, from about 0.5 to about 2%, by wt, of the dihydric alcohol is dissolved in the heavy hydrocarbon materials.

It should be understood that the heavy hydrocarbon materials can include both natural and synthetic pitches and that such materials can be used with the present invention. In certain aspects, the pitches are derived from coal or petroleum are specially preferred.

Suitable petroleum pitches are obtained, for example, as extraction residues by deasphalting treatment of heavy hydrocarbon oils, such as vacuum residue; residues from products of thermal cracking treatment of heavy hydrocarbon oils; residues from products of catalytic cracking of petroleum fractions; and from products of heat treatment from heavy carbon oils. Suitable coal tar pitches include vacuum bottoms of liquefied coal. Also, both the petroleum and coal pitches produced by using thermal treating or hydrogenating methods can be modified to reduce their viscosity with the method of the present invention.

The pitch products produced by the method of the present invention have a desired low viscosity, a desired high coking value, and a desired high softening point. Further, the pitch products produced according to the method of the present invention surprisingly contain less carcinogens than other types of petroleum and coal tar pitches.

It is not until the present invention that dihydric alcohol materials were thought of to reduce the viscosity of heavy hydrocarbons in materials such as pitch and asphalt.

We discovered that it was possible to use a dihydric alcohol as a viscosity modifier for heavy hydrocarbons. So far as is known, dihydric alcohol has never been used in this way.

Until the present invention, however, no-one had thought to use dihydric alcohol as suitable for a viscosity modifier for heavy hydrocarbon materials (such as pitch and asphalt) since pitch and asphalt have high molecular weights and are highly aromatic. In contrast, dihydric alcohol is aliphatic, has no sulfur, has no ring structures or aromatics, and is relatively low molecular weight, as compared to asphalt and pitch. While it could be argued that a linear, relatively low molecular weight, aliphatic molecule such as dihydric alcohol would be a good release agent, it would not be considered suitable as a viscosity modifier.

In spite of the teachings of the art, it was surprisingly found that the aliphatic dihydric alcohol materials work well as viscosity modifiers for heavy hydrocarbon materials.

The dihydric alcohols can comprise ethylene glycol, diethylene glycol, tri-ethylene glycol and mixtures thereof. It should be understood however, that, in other embodiments, other useful diols materials and mixtures of these and other diols, are within the contemplated scope of the present invention.

In one aspect, the present invention relates to the use of low concentrations of dihydric alcohol to produce a significant reduction in the softening point of heavy hydrocarbons. By blending the dihydric alcohol into heavy hydrocarbons, the viscosity of the molten hydrocarbon was profoundly reduced while the desirably high softening point and the coking value of the pitch were surprisingly maintained.

In a preferred method the dihydric alcohol is added to the pitch, rather than adding the pitch to the dihydric alcohol. In one embodiment, blending 1 wt % dihydric alcohol into A-240 pitch (having 121.1° C. softening point and a coking value of 51.1 wt %) has almost no effect on the softening point or coking value while significantly reducing the viscosity.

In another aspect, the present invention relates to a method for making a high softening point pitch and/or high coking value pitch that is less viscous during processing of the pitch. The reduced viscosity pitch made using this method is easier to process by the end user, especially when, for example, there is a need to add further ingredients or additives to the pitch and/or there is a need to transport the pitch through processing equipment.

In certain embodiments, the addition of dihydric alcohols to a pitch material such as A-240 petroleum pitch provides for a more efficient mixing at current processing temperatures and allows for equivalent mixing at reduced temperatures. This modification of the mixing step also improves the final mix in other applications where the pitch is mixed with other materials, such as in refractory, clay, coke and the like applications.

In certain other embodiments, the addition of dihydric alcohols to a pitch occurs as a final a "polishing" step of the pitch production process and/or as part of a post production process.

In yet another aspect of the present invention, the reduced viscosity of the pitch also improves the effectiveness of the pitch as an impregnant. The present invention thus further relates to the use of the dihydric alcohol modified pitch as an impregnate, and in particular, for the production of graphite electrodes for steel production via electric arc furnaces.

Low concentrations of dihydric alcohol cause significant changes in the viscosity of heavy hydrocarbons at temperatures below the boiling point of ethylene glycol (197° C.). In another aspect, the use of other glycols having higher boiling points (diethylene glycol b.p. 244° C. and triethylene glycol b.p. 287° C.) are used to increase the useful temperature range of this method to modify the viscosity of heavy hydrocarbons materials.

The reduction in viscosity improves the ability of the impregnation pitch to wet the carbon structures (used in making graphite anodes, for example) by improving the pitch's ability to enter pores of the carbon structures at the desired process temperatures (at about 225° C., for example, in the impregnating of carbon structures used in making graphite electrodes for use in the production of aluminum). The glycol fraction is then removed early in the graphite electrode baking process.

The viscosity reduction observed with dihydric alcohol is significantly greater than that observed with similar blends of A-240 pitch and No. 6 fuel oil. The addition of 2 wt % No. 6 fuel oil in A-240 pitch causes a viscosity reduction of 15% at 150° C., while the addition of 2 wt % dihydric alcohol to A-240 petroleum pitch causes about a 43% viscosity reduction at the same temperature.

While not wishing to be bound by theory, it is believed that the ability of dihydric alcohols to reduce viscosity in heavy hydrocarbons is a function of the original viscosity of the hydrocarbon. That is, the greatest percent reduction of viscosity occurs with samples under conditions where the absolute viscosity is highest. In particular, significant viscosity reductions are seen for samples and temperatures where the viscosity is above 100 centipoise.

The use of dihydric alcohols has little or no detrimental impact on other critical parameters of heavy hydrocarbons. The addition of ethylene glycol to A-240 pitch did not significantly reduce the softening point or the coking value of the pitch.

The dihydric alcohols provide an additional benefit due to its low toxicity. The dihydric alcohols are essentially free of aromatics and considered non-toxic for skin contact should any spills occur.

According to another aspect of the present invention, the reduction of the viscosity of petroleum pitch allows petroleum pitch to compete more favorably with coal tar pitch in certain markets. The use of dihydric alcohols modifies the pitch product viscosity which allows the pitch products to be made that better meet customer requirements. Normally, the use of heavy hydrocarbons requires the customer to heat the product to achieve a desired viscosity. With the present invention, customers are able to realize cost savings by being able to use the dihydric alcohol viscosity modified pitch product without the need to heat such product, or, alternatively, to use less energy to heat the pitch products to achieve a desired viscosity.

The present invention also provides for an improved end product. Specifically, in the applications where the dihydric alcohols are used with petroleum pitch, a reduced softening point is achieved while still maintaining a desired coking value. This petroleum pitch is especially useful in applications which had not previously been found suitable for neat petroleum pitch (without the dihydric alcohols viscosity modification). For example, the addition of about 2 wt % of dihydric alcohols to A-240 petroleum pitch provides about a 118° C. softening point pitch with a coking value that is about 50.

As another example, the dihydric alcohols are also especially useful as viscosity modifier for asphalt production. In particular, the modification of the asphalt product, as used by customers, allows the asphalt to be applied, or laid down, in cold environments and onto cold surfaces. The viscosity modified asphalt of the present invention has improved flowability that continues throughout the customer's entire application process. The end use customer can specify whether the asphalt, having the dihydric alcohols viscosity modifier of the present invention therein, will harden under ambient or other specified conditions. The end use customer can specify the time needed to keep the viscosity of the present invention viscosity modified asphalt within a certain defined parameters. The present invention thus provides an improved asphalt product for cold patching of roads, parking lots, runways and other surfaces. Thus, according to one aspect of the present invention, the reduced viscosity of the asphalt or other cold type patching material (in which the asphalt is used as a binder) allows the asphalt products to be applied in normally wet and cold conditions.

The following examples are intended only to further illustrate the invention and are not intended to limit the scope of the invention as defined by the claims.

EXAMPLE I

The ability of the dihydric alcohol to desirably reduce the softening point of A-240 petroleum pitch compared to No. 6 fuel oil, and diabasic esters and ethylene glycol is shown in FIG. 1.

EXAMPLE II

| | Experiment A - A 240 Pitch | | | | | | | | |
|---|---|---|---|---|---|---|---|---|---|
| | Sample | | | | | | | | |
| | A | A-0.05 | Percent Change | A-1 | Percent Change | A-2 | Percent Change | A-5 | Percent Change |
| Percent A 240, wt % | 100 | — | — | 99.0 | — | — | — | 95.0 | — |
| Percent Ethylene Glycol | 0 | — | — | 1.0 | — | — | — | 5.0 | — |
| Softening Point, Mettler, ° C., ASTM D 3104 | 120.1 | — | — | 118.2 | 1.6 | — | — | 117.6 | 2.1 |
| Rotational Viscosity (Brookfield, ASTM D 4402) | | | | | | | | | |
| Temperature 150° C. | 8676 | — | — | 4960 | 42.8 | — | — | 4432 | 48.9 |
| 175° C. | 665 | — | — | 460 | 30.8 | — | — | 352 | 47.1 |
| 200° C. | 140 | — | — | 94 | 32.9 | — | — | 75 | 47.1 |
| 225° C. | 48 | — | — | 37 | 22.9 | — | — | 32 | 33.3 |

-continued

| Experiment B - A 240 Pitch | Sample | | | | | | | | |
|---|---|---|---|---|---|---|---|---|---|
| | B | B-0.05 | Percent Change | B-1 | Percent Change | B-2 | Percent Change | B-5 | Percent Change |
| Percent A 240, wt % | 100 | 99.5 | — | 99.0 | — | 98.0 | — | 95.0 | — |
| Percent Ethylene Glycol | 0 | 0.5 | — | 1.0 | — | 2.0 | — | 5.0 | — |
| Softening Point, Mettler, ° C., ASTM D 3104 | 121.2 | 120.2 | 0.8 | 118.6 | 2.1 | 116.8 | 3.6 | 117.5 | 3.1 |
| Coking Value, Modified Conradson Carbon, ASTM D 2416, wt % | 50.7 | 50.1 | 1.2 | 49.6 | 2.2 | 49.6 | 2.2 | 47.7 | 5.9 |
| Rotational Viscosity (Brookfield, ASTM D 4402) | | | | | | | | | |
| Temperature 150° C. | 7536 | 6796 | 9.8 | 4296 | 43.0 | 4065 | 46.1 | 3264 | 56.7 |
| 175° C. | 681 | 661 | 2.9 | 494 | 27.5 | 450 | 33.9 | 315 | 53.7 |
| 200° C. | 137 | 137 | 0.0 | 108 | 21.2 | 101 | 26.3 | 62 | 54.7 |
| 225° C. | 45 | 45 | −0.4 | 42 | 6.2 | 40 | 11.8 | 32 | 28.6 |

| Experiment C - Coal Tar Pitch | Sample | | | | | | | | |
|---|---|---|---|---|---|---|---|---|---|
| | C | C-0.05 | Percent Change | C-1 | Percent Change | C-2 | Percent Change | C-5 | Percent Change |
| Percent Coal Tar Pitch, wt % | 100 | — | — | 99.0 | — | — | — | 95.0 | — |
| Percent Ethylene Glycol | 0 | — | — | 1.0 | — | — | — | 5.0 | — |
| Softening Point, Mettler, ° C., ASTM D 3104 | 112.5 | — | — | 106.8 | 5.1 | — | — | 104.5 | 7.1 |
| Rotational Viscosity (Brookfield, ASTM D 4402) | | | | | | | | | |
| Temperature 150° C. | 5184 | — | — | 3000 | 42.1 | — | — | 1561 | 69.9 |
| 175° C. | 536 | — | — | 506 | 5.6 | — | — | 213 | 60.3 |
| 200° C. | 151 | — | — | 134 | 11.3 | — | — | 84 | 44.4 |
| 225° C. | 63.4 | — | — | 56.6 | 10.7 | — | — | 46 | 27.4 |

| Properties of Pure Glycol Compounds | Ethylene Glycol | Diethylene Glycol | Triethylene Glycol |
|---|---|---|---|
| Molecular weight, ° C. | 62 | 106 | 150 |
| Boiling point @ 760 mm Hg, ° C. | 197.2 | 244.8 | 287.4 |
| Flash point, Pensky Marten Closed Cup, ° C. | 244 | 290 | 335 |
| Freezing point, ° C. | −13 | −10.5 | −7.2 |
| Specific gravity @ 20° C. g/cc | 1.1155 | 1.1184 | 1.1254 |
| Specific heat, 0° C., cal/gm/° C. | 0.544 | 0.551 | 0.525 |
| Viscosity @ 20° C., cp. | 20.9 | 35.7 | 47.8 |
| Density @ 20° C., lb/gal | 9.31 | 9.31 | 9.36 |
| Vapor pressure @ 20° C., mm Hg | 0.1 | 0.01 | 0.01 |

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A method of reducing the viscosity of heavy hydrocarbon materials comprising:

heating a heavy hydrocarbon material having a relatively high softening point and a relatively high viscosity to produce a molten material, dissolving in the molten material a viscosity reducing amount of from about 0.5 to about 5 wt % of at least one dihydric alcohol, and producing a low viscosity, high softening point heavy hydrocarbon material having a softening point above 100° C.

2. The method of claim 1 wherein the hydrocarbon material has a softening point above 120° C.

3. The method of claim 1 wherein about 1 to about 2 wt % of the at least one dihydric alcohol is dissolved in the hydrocarbon material.

4. The method of claim 1, wherein the hydrocarbon material comprises petroleum pitch.

5. The method of claim 1, wherein the hydrocarbon material comprises coal tar pitch.

6. The method of claim 1 wherein the dihydric alcohol comprises ethylene glycol.

7. The method of claim 1, wherein the dihydric alcohol comprises diethylene glycol.

8. The method of claim 1, wherein the dihydric alcohol comprises tri-ethylene glycol.

9. The method of claim 7, wherein the dihydnic alcohol comprises a mixture of at least two of ethylene glycol, diethylene glycol, and tri-ethylene glycol.

10. Low viscosity, high softening point heavy hydrocarbon material having a softening point above 100° C. comprising:

a heavy hydrocarbon material having a relatively high softening point and a relatively high viscosity, and a viscosity reducing amount of from about 0.5 to about 5 wt % of at least one dihydric alcohol dissolved in the heavy hydrocarbon material.

11. The heavy hydrocarbon material of claim 10, wherein the heavy hydrocarbon material has a softening point above 120° C.

12. The heavy hydrocarbon material of claim 10, wherein about 1 to about 2 wt % of the at least one dihydric alcohol is dissolved in the heavy hydrocarbon material.

13. The heavy hydrocarbon material of claim 10, wherein the heavy hydrocarbon material comprises petroleum pitch.

14. The heavy hydrocarbon material of claim 10, wherein the heavy hydrocarbon material comprises coal tar pitch.

15. The heavy hydrocarbon material of claim 10, wherein the dihydric alcohol comprises ethylene glycol.

16. The heavy hydrocarbon material of claim 10, wherein the dihydric alcohol comprises diethylene glycol.

17. The heavy hydrocarbon material of claim 10, wherein the dihydric alcohol comprises tri-ethylene glycol.

18. The heavy hydrocarbon material of claim 10, wherein the dihydric alcohol comprises a mixture of at least two of ethylene glycol, diethylene glycol, and tri-ethylene glycol.

19. A method of reducing carcinogenicity of a starter pitch comprising (i) a distillable carcinogenic pitch fraction and (ii) a higher boiling, or nondistillable, pitch fraction having a softening point of about 100° C. having a reduced carcinogen level and an unacceptably high viscosity and/or softening point, comprising:

(a) distilling from the starter pitch at least a portion of the distillable carcinogenic pitch fraction to produce a reduced carcinogen pitch fraction with an unacceptably high molten viscosity; and (b) reducing the viscosity of the reduced carcinogen pitch fraction by dissolving therein a viscosity reducing amount of from about 0.5 to about 5 wt % of at least one dihydric alcohol to produce as a product a low carcinogen pitch product having an acceptable molten viscosity.

20. The method of claim 19, wherein the starter pitch comprises petroleum pitch.

21. The method of claim 19, wherein the starter pitch comprises coal tar pitch.

22. The method of claim 19, wherein the dihydric alcohol comprises ethylene glycol.

23. The method of claim 19, wherein the dihydric alcohol comprises diethylene glycol.

24. The method of claim 19, wherein the dihydric alcohol comprises tri-ethylene glycol.

25. A carbon structure impregnated with the hydrocarbon of claim 10.

26. The carbon structure of claim 25 used as an electrode.

* * * * *